United States Patent [19]

Dowd et al.

[11] 4,156,487

[45] May 29, 1979

[54] HOSE GUARD

[75] Inventors: Allyn C. Dowd, Sterling Heights; Miles N. Stiller, West Bloomfield, both of Mich.

[73] Assignee: Massey-Ferguson Inc., Detroit, Mich.

[21] Appl. No.: 817,871

[22] Filed: Jul. 21, 1977

[51] Int. Cl.[2] ..... E02F 3/36

[52] U.S. Cl. ..... 414/694; 16/2; 138/110; 174/153 G; 280/420; 414/918

[58] Field of Search ..... 214/138 R, DIG. 11; 280/420, 421; 16/2; 138/110; 191/12 R; 174/152 G, 153 G

[56] References Cited

U.S. PATENT DOCUMENTS

| | | | |
|---|---|---|---|
| 918,969 | 4/1909 | Cole | 174/152 G |
| 2,912,712 | 11/1959 | Shamban et al. | 174/153 G X |
| 3,082,890 | 3/1963 | Auwelaer et al. | 214/138 C |
| 3,263,839 | 8/1966 | Hauff | 214/138 R |
| 3,352,574 | 11/1967 | Brian | 16/2 X |
| 3,991,446 | 11/1976 | Mooney et al. | 16/2 X |

*Primary Examiner*—L. J. Paperner
*Attorney, Agent, or Firm*—William R. Nolte

[57] ABSTRACT

A high density polyethylene molding frames an opening in a casting through which hydraulic hoses must pass to protect the hoses from abrasion in contacting the edges and sides of the casting opening. The molding is flexible and resilient to enable it to be snapped in and out of the opening in the casting while providing a generally frictionless surface against which the hoses may be guided in their normal movement through the opening under operating conditions.

4 Claims, 3 Drawing Figures

HOSE GUARD

The present invention relates to guards and more particularly to hose guards for hoses carrying high pressure hydraulic fluid. A problem perpetual to hydraulic hoses, particularly when they are large diameter and carrying high pressure fluid, has been how to guard the hoses against excessive wear, particularly at points where the hoses are required to negotiate bends on articulated equipment causing the hoses to experience movement relative to the pieces forming the articulated joint or joints. A further problem is to prevent the hydraulic hoses from foul or otherwise interfering with the relative movement between the pieces.

The above type problems are particularly acute in industrial equipment such as backhoes of the type mounted on a transverse supporting frame attached to the rear end of a tractor or similar vehicle, the backhoe boom assembly being mounted for side to side swinging movement on a swing unit carried by the transverse supporting frame. The hydraulic actuators for the backhoe with a swing unit are connected into the tractor hydraulic system by flexible conduits. The operator can cause the backhoe boom to swing about a vertical axis, and to perform excavating operations by manipulating hydraulic control levers causing pressurized hydraulic fluid to flow to and from the actuators.

A particularly acute situation exists on the above machines where the backhoe boom is articulated with respect to the swing casting for swinging the boom from side to side. All the hydraulic hoses for supplying the various cylinders on the backhoe such as the boom, dipper and bucket cylinders must pass the point of articulation between the swing casting and the backhoe boom. Not only do all the hoses have to pass the point of articulation described above, but this point of articulation is in close proximity to the pivot point for the swing casting through which the hoses also must pass, or be reasonably routed therearound, thereby creating an excessive amount of movement of the hoses in this area.

Previously known solutions to the above problem include use of guarded hoses as well as hoses with sleeves thereon to protect them against abrasion. Also, there have been attempts to limit the movement of the hoses by clamping them in position and the introduction of manifolds to retain the hoses in position wherein the hoses are routed around points of difficulty as described above. The use of guarded hose and sleeves thereon present problems of requiring additional space because they are bulky and inhibit the bending of the hose which is required to achieve the desired articulation in swinging of the backhoe swing unit and pivoting of the boom. The use of the manifold normally required in passing the hoses below the above-mentioned critical points reduces the ground clearance for the backhoe while at the same time introducing substantial cost increases since manifolds generally are expensive. Further, all the above approaches introduce further costs to the system.

The present invention addresses itself to the above problems in a guard to overcome the problems, and more particularly to a guard for a tractor implement. The implement has a housing such as a casting with an aperture in it through which cables or conduits, such as hoses pass. The guard forms a border on the casting aperture and can be a molding framing the periphery of the casting aperture covering all the edges of the casting forming the periphery. The periphery of the aperture has at least a pair of spaced apart opposing edges thereon for mating with first and second extensions of the molding which extend outwardly from the molding and may extend in opposite directions. First and second extensions are spaced apart a distance greater than the opposing peripheral edges of the casting aperture with which they mate upon assembly. At least a portion of the molding is flexible to permit the first and second extensions to be snapped into and out of the casting aperture by converging them toward each other upon assembly with the casting to a distance less than that of the opposing peripheral edges.

Further, the guard provides portions thereof for mating with portions of the periphery of the casting thereby providing a protective surface between the conduits and the casting peripheral portions.

The above guard has the advantages of being a simple, inexpensive one piece molding. The molding can be simply snapped into or out of position within the casting aperture thereby requiring no other fastening means. Preferably, the molding is made of a flexible material such as polyethylene which permits enough flexure of the mold to accomplish the snap in and snap out assembly. Preferably also, the mold is conformed to the shape of the casting about the aperture therein.

Further advantages include extensions on the mold for enhancing assembly by being convergent toward each other to permit them to initially pass the limits of the casting aperture and subsequently be extended within the aperture to retain the molding on the casting. The molding material is of a nature to provide a low friction coefficient between it and the hoses passing through the casting aperture. Finally, the molding has complementary surfaces which provide extensive area for covering the surfaces of the casting to provide additional protection for the hoses passing therethrough. The above objects and advantages of the invention will become readily apparent to one skilled in the art from reading the following detailed description of an embodiment of the invention when considered with further objects thereof in light of the accompanying drawings in which:

Figure 1:
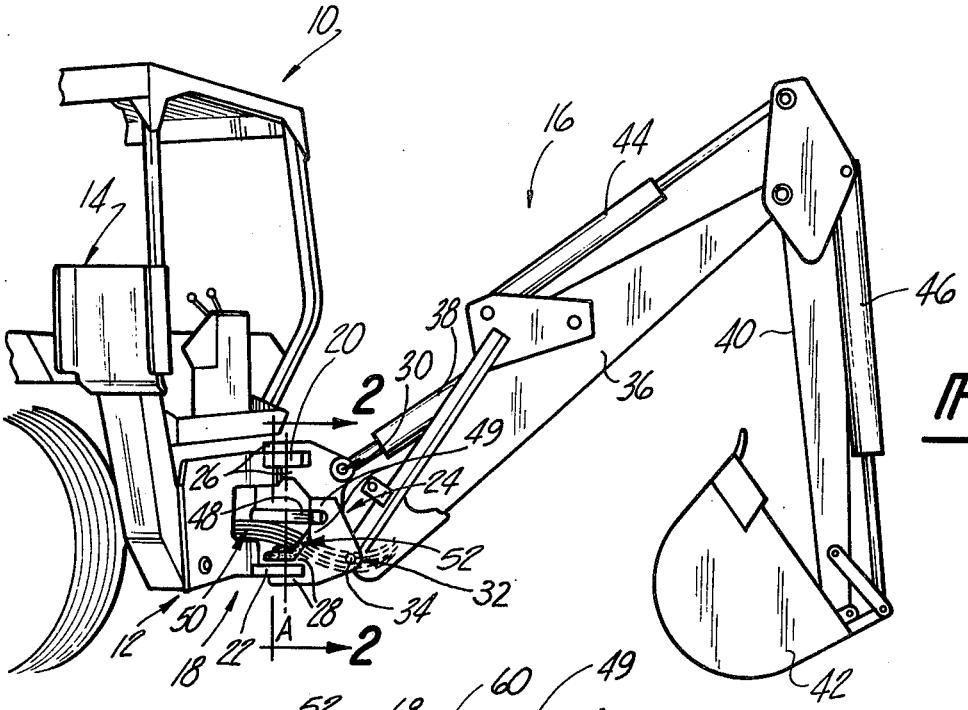
FIG. 1 is a perspective view of a portion of a tractor with a backhoe thereon embodying the structure of the present invention.

Referring to the drawings, there is illustrated in FIG. 1 the rear portion of a conventional tractor designated generally by the reference character 10. The tractor 10 has incorporated therein a hydraulic system, not shown, but of the usual and conventional type. Supported from the rear end of the tractor 10 is a transverse upright supporting stand 12 having retractable legs, one of which is shown on the left end at 14, on opposite ends. The supporting legs 14 may be raised to permit transporting of a backhoe 16 and may be lowered for supporting the backhoe 16 when it is in operation.

The supporting stand 12 supports a rearwardly projecting backhoe support 18. The backhoe support 18 has upper and lower rearwardly projecting portions 20 and 22, respectively. Supported on the portions 20 and 22 is a swing casting 24 having upper and lower forwardly projecting ears or lugs 26, 28 pivotally connected to the portions 20, 22 to swing about a vertical axis A. The swing casting 24 has upper and lower rearwardly projecting pivots 30, 32 respectively, the lower of which receives a transverse horizontal pivot pin 34 connecting thereto a vertically swingable boom structure 36. The upper pivot 30 receives a conventional type extensible and retractable hydraulic cylinder 38 which operates to raise and lower the boom 36. The outer or rear end of the boom 36 has pivotally mounted thereon a dipper stick 40 which in turn has a bucket 42 pivotally mounted at its outer end. Extensible and retractable hydraulic cylinders 44, 46 operate to move the dipper stick 40 and bucket 42 about their pivots, respectively.

The tractor 10 and backhoe 16 have been described generally for purposes of orientation. They both are conventional in the operation described with the swing casting 24 being moved from side to side by linear cylinders (not illustrated) a rod 48 of one of which can be seen illustrated in FIG. 1 interconnecting the supporting stand 12 with the swing casting 24 by lugs 49 thereon to which which it is pivotally connected. Thus, the boom 36 is free to pivot from side to side about the vertical axis A while being raised and lowered about the pin 34 to position the dipper stick 40 which is pivoted thereon in a digging and/or transport position to provide the normal flexibility of operation of the bucket 42 in digging and dumping operations.

The cylinders 38, 44 and 46 require hydraulic fluid to be transmitted thereto and returned therefrom in order to power them. To accommodate the flow of hydraulic fluid, a series of hoses 50 must pass the vertical axis A as well as the pivot pin 34 for the boom 36. Thus, the hoses 50 interconnect the hydraulic system of the tractor 10 with the operative cylinders 38, 44 and 46.

Figure 2:
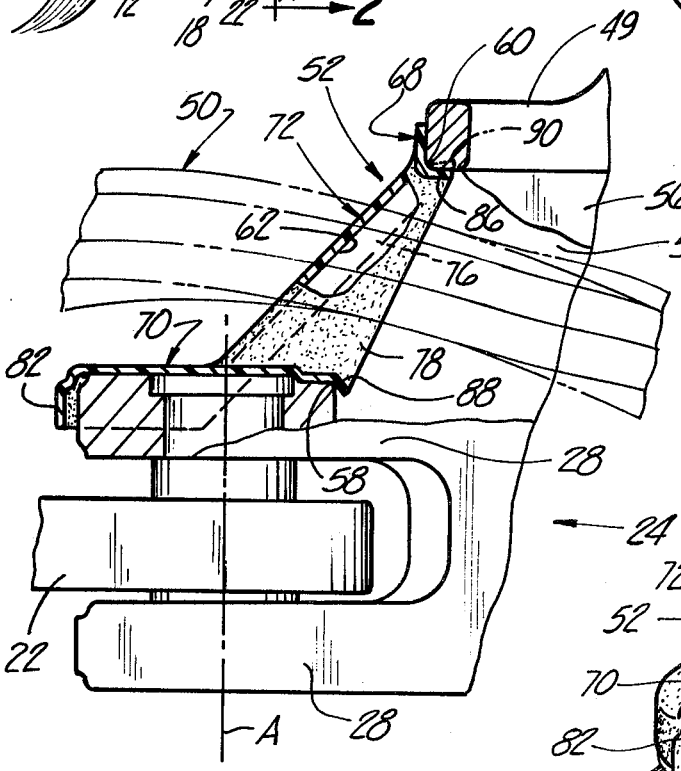
FIG. 2 is a fragmentary cross-sectional view along line 2—2 of FIG. 1 being an enlargement of that fragmentary portion with parts thereof broken away for further clarification.
Figure 3:
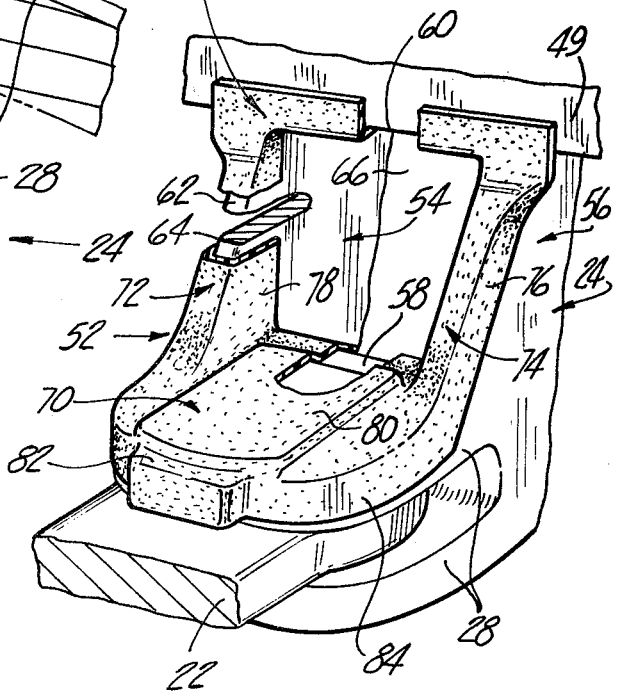
FIG. 3 is a perspective view looking down on top of the components illustrated in FIG. 2.

The hoses are illustrated in phantom in FIG. 2 to permit better illustration of the pertinent portions of the swing casting 24 together with a guard illustrated in the present embodiment as the moulding 52. In FIG. 3 the moulding 52 can be seen to completely encompass the periphery of an aperture formed in the casting 24 by the side walls 54 and 56 the bottom edge 58 and top edge 60. One of the side wall faces 62 is illustrated in FIG. 3 therein parts are broken away to show its general cross-section. The face 62 is formed because of the substantial thickness of the side wall 54 which has rounded or radiused edges 64. The face 62 for the side wall 54 is indictive of that for the side wall 56 which, as illustrated in FIG. 3, is completely covered by the moulding 52. The inner edges 64 of the sides 54 and 56 together with upper edge 60 and bottom edge 58 completely frame the aperture 66 within the casting 24.

The moulding 52 conforms to the shape of the portions of the casting 24, most particularly the edges 58, 60, 64, to which it is attached. The molding 52 has upper and lower portions in the form vertical face 68 and horizontal base 70. Sides 72 and 74 of the molding 52 extend between the vertical face 68 and lower base 70. The sides 72, 74 are bifurcated with an outer part 76 illustrated on the right of FIG. 3 and an inner part 78 illustrated on the left. The parts 76, 78 of the sides 74 and 72 cover the edges 64 of the side walls 54, 56 of the casting 24 and form extensions into the aperture 66, in the case of the inner parts 78, and over the outside of the side walls 54, 56 in the case of the outer parts 76. The inner part 78 can be seen to extend further rearwardly of the tractor 10 than outer part 76. The part 78 which exists for both sides 72, 74 of the molding 52 covers an appreciable portion of the inner face of the side wall 54 as would its counterpart for the inner face of the side wall 56 to thereby shield the hose 50 illustrated in FIG. 2 from abrasion against the sides 54, 56 of the casting 24.

The molding 52 is made from a low friction material, preferably a polyethylene which can be molded to the exact shape of the casting 24 surrounding the aperture 66. While other materials could be used for the molding 52, they would have the low friction property and preferably a further property of flexibility.

The advantage of the molding 52 in providing a guard for the hoses 50 is apparent in its conformity not only to the aperture 66 but also to accommodate the componetary of the pivot axis A housed beneath the raised portion 80 in the horizontal base 70. A lug on the end of the upper projecting ear 28 is accommodated by the portion 82 of the molding 52. Thus, the portion 82 covering the lug does not interfere with the skirt portion 84 which extends down over the upper ear 28 of the casting 24. The skirt 84 together with the bifurcated sides 72 and 74 of the molding 52 provide stability in the lateral direction in maintaining the molding 52 on the casting 24.

Referring to FIG. 2, it will be appreciated that in the swinging of the casting 24 the hoses 50 will move from left to right and back again, as illustrated therein, and thus it is necessary for the molding 52 to be fastened against such movement which would otherwise cause the molding 52 to be removed from the aperture 66. Further, pivoting of the boom 36, as illustrated in FIG. 1, will cause the hoses 50 not only to move from left to right but in a vertical plane as well at times engaging the upper edge 60 of the aperture 66 and at other times, sliding across the base 70 of the molding 52. Thus, the extension of the base 70 forwardly of the tractor 10 permits coverage of the vertical axis A and thus protection from dirt for the axis componentry while at the same time providing a low friction surface upon which the hoses 50 may slide when in contact with the bottom of the aperture 66.

In the embodiment illustrated, six hoses, two for each of the cylinders illustrated pass through the aperture 66. However, other embodiments having optional features incorporating hydraulics could increase the number of hoses in the present embodiment to eight or more. Clearly, the number of hoses is dependent upon the number of hydraulically driven components on the backhoe 16 or similar type implement attached to the rear of the tractor. Thus, the concept is not limited to the particular embodiment illustrated here but could be applied to any application wherein hoses or like type conduits are required to pass through apertures in members which would preferably be protected with respect to the hoses rubbing against the edges of the aperture and otherwise causing abrasion of the hoses.

In FIG. 2 the upper and lower portions of the moulding 52, in particular the base 70 and upper face 68, can be seen to have extensions directed rearwardly of the tractor 10 in the form of upper and lower lips 86 and 88. The upper lip 86 can be seen to be illustrated in phantom at 90 indicating its position in the relaxed or nonassembled condition. The lip 86 in its assembled condition in FIG. 2 is sprung downwardly to provide bias to retain the molding 52 within the recess 66 of the casting 24. The bias provided by the upper lip 86 acts in conjunction with the lower lip 88 to provide a means of securing the molding 52 within the casting 24. It will be appreciated that the upper and lower lip 86, 88 even in the unrelaxed position illustrated in FIG. 2 have a distance between their outer edges greater than that between the upper and lower edges 60, 58 of the casting 24. Therefore, in order to install the molding 52 within the aperture 66 of the casting 24 it is necessary to compress the molding 52 whereby the upper and lower lips 86, 88 are caused to converge towards each other in order to permit them to pass the upper and lower edges 60, 58 of the casting 24. Once the upper and lower lips of the molding 52 have passed the edges of the casting 24, the lower edge 88 can diverge to its relaxed position, but the upper lip 86 is not permitted to return entirely to its relaxed position as indicated at 90 but only partially thereto, whereby it continues to provide a bias to thereby retain the molding 52 on the casting 24.

It was found that the upper lip 86 has to be extended sufficiently rearwardly of the tractor 10 to obtain the necessary holding bias whereas a short lip initially tried was not satisfactory. Similarly, the lower lip 88 must be long enough to extend within the aperture 66; but, clearly, if it was made too long it would prevent the molding 52 from being capable of being snapped into place.

The upper face 68 together with the upper lip 86 and the lower base 70 together with the lower lip 88 form a frame of the molding 52 having surfaces extending away from each other and joined at the upper and lower edges 60 and 58, respectively, of the aperture 66 of the casting 24. One surface, for example, face 68, extends over the face of the lug 49 of the casting 24 and the other surface, for example, upper lip 86 extends within the aperture 66. The same is true for the sides 72, 74 of the molding 52 which cover the face 62 of the casting side walls 54, 56 as well as having extensions within the aperture 66 in parts 78. Thus, a border is formed over the entire periphery of the aperture 66 having surfaces extending over both the face and the inner portion of the casting forming the aperture 66 therein.

While other materials could be used for the molding 52, such as plastics or other low friction matrials, the polyethylene material chosen for the present embodiment is particularly suited for use with hydraulic hoses in that it has characteristics which are resistant of deterioration under exposure to hydraulic fluid. Also, the polyethylene is not subjected to oxidation as would be metals which could otherwise be used. It is also preferable, as illustrated in the present embodiment, to cover the whole periphery of aperture 66, but there could be applications where only some of the surfaces of the periphery of the aperture need be covered.

Fasteners could also have been used in conjunction with the molding 52 to thereby attach it to the casting 24 but were found not to be necessary when the upper and lower lips 86, 88 were incorporated into the moulding 52.

As mentioned previously, the extension 76 of the sides 72, 74 of the molding 52 does not extend as far rearwardly of the tractor 10 as the inner extension 78 and the distance of extension of both these extensions are governed by good design and how much of the surface area need be covered to properly protect the hoses passing through the aperture 66. In the present embodiment the extension 76 provides a clean finish to the rounded corner of the molding side 74 and it will be noted that all the junctions of surfaces forming corners on the moulding 52 form radii to enhance the movement of the hoses there passed and eliminate any edges on which the hoses might otherwise get caught.

The guard illustrated provides a compact, simple, economical an easily installed and removed guard for hoses and like type appliance through any aperture in a casting. It is to be understood, however, that the aperture need not be in a casting but could be in any support member for an implement of any kind attached to a tractor having hoses extending between a tractor hydraulic system and operative portions of an implement which are hydraulically driven. Further, the drive would be applicable to hoses other than hydraulics such as pneumatic hoses. Still further, the guard could be applicable to other flexible connections, such as cables.

In accordance with the provisions of the patent statutes, the principle and mode of operation of the device has been explained and what is considered to represent its best embodiment has been illustrated and described. It should, however, be understood that the invention may be practiced otherwise than as specifically illustrated and described without departing from its spirit or scope.

We claim:

1. A guard for a tractor implement assembly in which a tractor has a hydraulic system and the implement has a supporting stand connected to the tractor, a boom structure, swivel means swingable about an axis and mounting the boom structure on the supporting stand, including a swing casting with an aperture therein, space apart pivots on said first axis supporting said swing casting, a second pivot axis for swinging said boom on said swing casting, hydraulic means associated with the boom structure, and hydraulic conduit means extending from the hydraulic system between said spaced apart pivots on said swing casting through said casting aperture to the hydraulic means, said guard located between said first and second axis and comprising: a first portion of said guard and a first portion of the periphery of said casting aperture for mating with each other, a second portion of said guard and a second portion of the periphery of said casting for mating with each other, said first and second portion of said guard and casting aperture periphery, respectively, spaced apart from each other, said first and second guard portions spaced a distance greater than said first and second peripheral portions in a nonmating condition and convergent to permit a snap in assembly with said guard portions providing a protective surface between the conduits and said casting aperture peripheral portions.

2. The guard defined in claim 1 wherein said guard is a molding conforming to the shape of the aperture in the swing casting.

3. The guard defined in claim 1 wherein at least one of said guard portions includes a resilient lip flexed toward said other guard portion in the assembled condition to maintain a bias on said other guard portion to retain said guard within the swing casting aperture.

4. A guard for a tractor implement assembly in which a tractor has a hydraulic system and the implement has a supporting stand connected to the tractor, a boom structure, swivel means mounting the boom structure on the supporting stand, including a swing casting with an aperture therein, hydraulic means associated with the boom structure, and hydraulic conduit means extending from the hydraulic system through said casting aperture to the hydraulic means, said guard comprising: a first portion of said guard and a first portion of the periphery of said casting aperture for mating with each other, a second portion of said guard and a second portion of the periphery of said casting for mating with each other, said first and second portion of said guard and casting aperture periphery, respectively, spaced apart from each other, said first and second guard portions spaced a distance greater than said first and second peripheral portions in a nonmating condition and convergent to permit a snap in assembly with said guard portions providing a protective surface between the conduits and said casting aperture peripheral portions, and including a pivot for the swivel means and a third portion of said guard extending over the pivot forming a cover for the pivot and providing a protective surface between the conduits and the pivot.

* * * * *